United States Patent [19]

Tasaka

[11] 4,253,204

[45] Mar. 3, 1981

[54] BED FURNITURE ASSEMBLY

[76] Inventor: Makoto Tasaka, No. 15-17 1-Chome, Ohkura, Setagaya-ku, Tokyo, Japan

[21] Appl. No.: 30,365

[22] Filed: Apr. 16, 1979

[51] Int. Cl.[3] ..... A47B 83/00; A47B 87/00

[52] U.S. Cl. ..... 5/2 R; D6/80; 5/9 R

[58] Field of Search ..... 5/2 R, 8, 9; 312/198; D6/80

[56] References Cited

U.S. PATENT DOCUMENTS

| | | | |
|---|---|---|---|
| 3,325,233 | 9/1965 | Oppenhuizen et al. | 5/2 R |
| 3,427,666 | 2/1969 | Saxe | 5/2 R |
| 3,950,796 | 4/1976 | Hollingsworth | 5/9 R |
| 4,109,328 | 8/1978 | Mason | 5/8 |

*Primary Examiner*—Casmir A. Nunberg

*Attorney, Agent, or Firm*—Oblon, Fisher, Spivak, McClelland & Maier

[57] ABSTRACT

A complete knockdown type bed furniture assembly including a bed, a wardrobe and a desk is disclosed. The entire structure of the assembly is mainly composed of a variety of panels and boards, or frames removably coupled to one another manually with screw-bolts which, when disassembled, can be laid substantially flat one above another to make themselves a flat compact form without occupying an unnecessarily large space, especially in transportation and storage.

6 Claims, 8 Drawing Figures

BED FURNITURE ASSEMBLY

BACKGROUND OF THE INVENTION

1. Field of the Invention

The present invention relates to a bed furniture assembly of the type comprising a bed section arranged at the upper portion of the assembly and a housing or wardrobe section and a desk or bookrack section integrally arranged within a clearance provided under the bed so that limited room space may be effectively utilized.

2. Description of the Prior Art

In the conventional bed furniture assembly of this type, the overall size of the assembly becomes inevitably large because of its structure, and the space occupied is extremely large as compared with the volume of each structural member of the assembly. Thus, the conventional bed furniture assembly requires a wide space for the custody thereof in the course of its circulation such as transportation as well as in storage. In addition, it is not easy to market because of an increase in the selling cost.

SUMMARY OF THE INVENTION

To overcome the above disadvantages, the bed furniture assembly of the present invention is constructed in such a manner that the panels and boards or frames constituting the assembly is removably fixed to one another. At the same time, they can be disassembled into a compact size and laid substantially flat one above another so as to eliminate wider space which is otherwise required for the custody thereof during transportation as well as in storage, thereby reducing the selling cost in a considerable amount.

Accordingly, an object of the present invention is to provide a bed furniture assembly of the type comprising a bed section, a housing or wardrobe section and a desk or bookrack section, respectively, and in which all the structural members such as panels and boards that constitute the assembly are removably fixed to one another.

Another object of the present invention is to provide a bed furniture assembly of the above type in which all the structural members can be disassembled into a compact size so that no wide space is required for its transportation and storage.

A further object of the present invention is to provide a bed furniture assembly of the above type in which the position of each section excluding the bed section can be selectively displaced and which can be utilized for a variety of purposes without any difficulty or without adding any further members thereto.

A still further object of the present invention is to provide a bed furniture assembly which is easy to handle, simple in construction and which is available at reduced selling cost.

Other objects and advantages of the present invention will become apparent from the following detailed description with respect to a preferred embodiment of the present invention when taken in conjunction with the accompanying drawings.

DETAILED DESCRIPTION OF THE PREFERRED EMBODIMENTS

Figure 1:
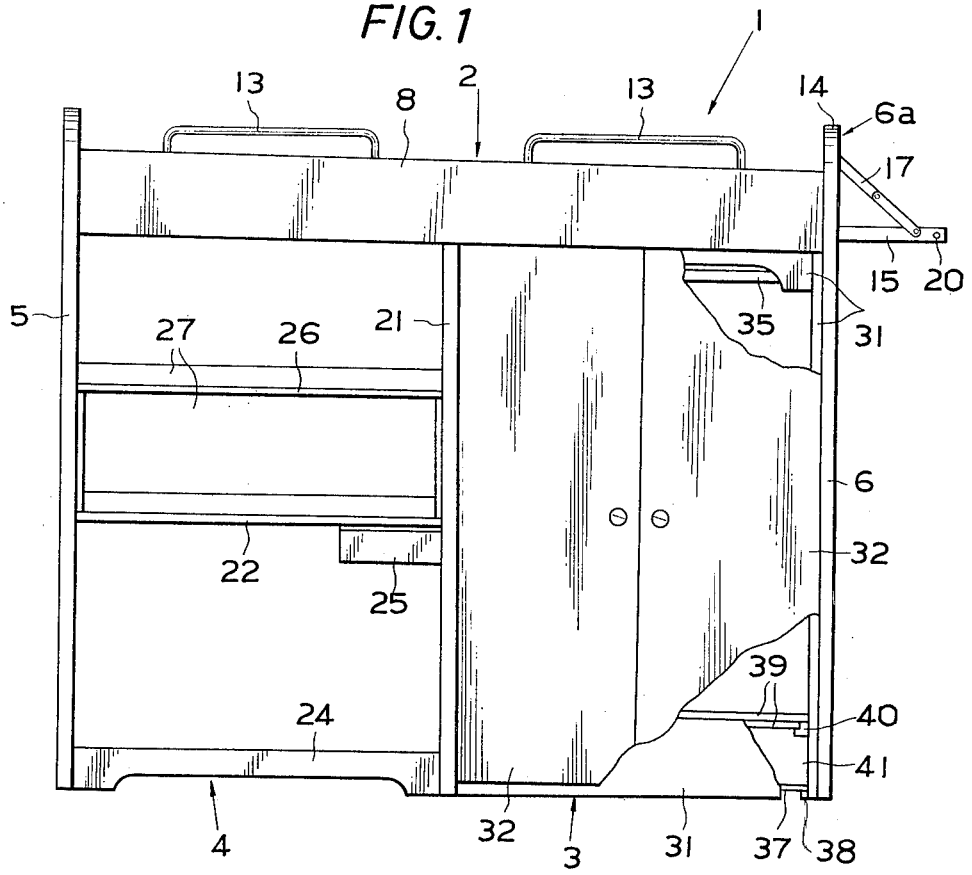
FIG. 1 is a partly broken away front view of a bed furniture assembly of the present invention.
Figure 2:
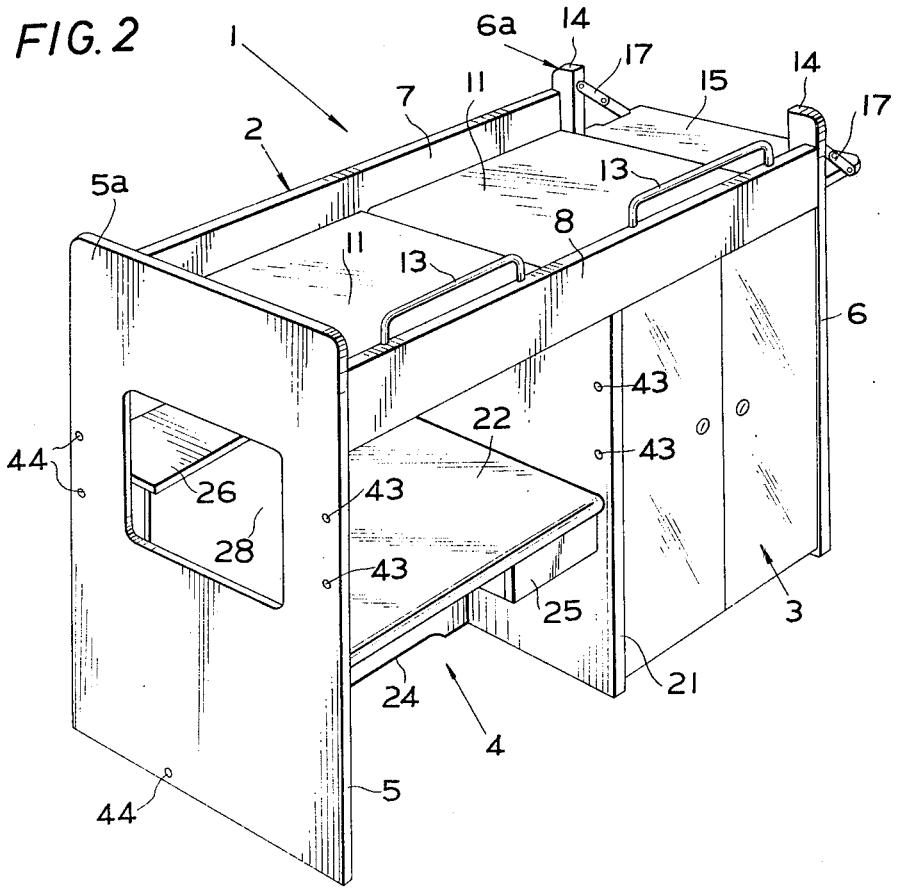
FIG. 2 is a perspective view of a bed furniture assembly of the present invention.

Referring to FIGS. 1 and 2, a bed furniture assembly of the present invention comprises a bed section 2, a housing or wardrobe section 3 and a desk or bookrack section 4 which are arranged in such a manner that the bed section is located at the upper portion of the assembly and the other two sections are located within a clearance provided under the bed section and the assembly presents, as a whole, an integral structure in the shape of a rectangle.

Figure 4:
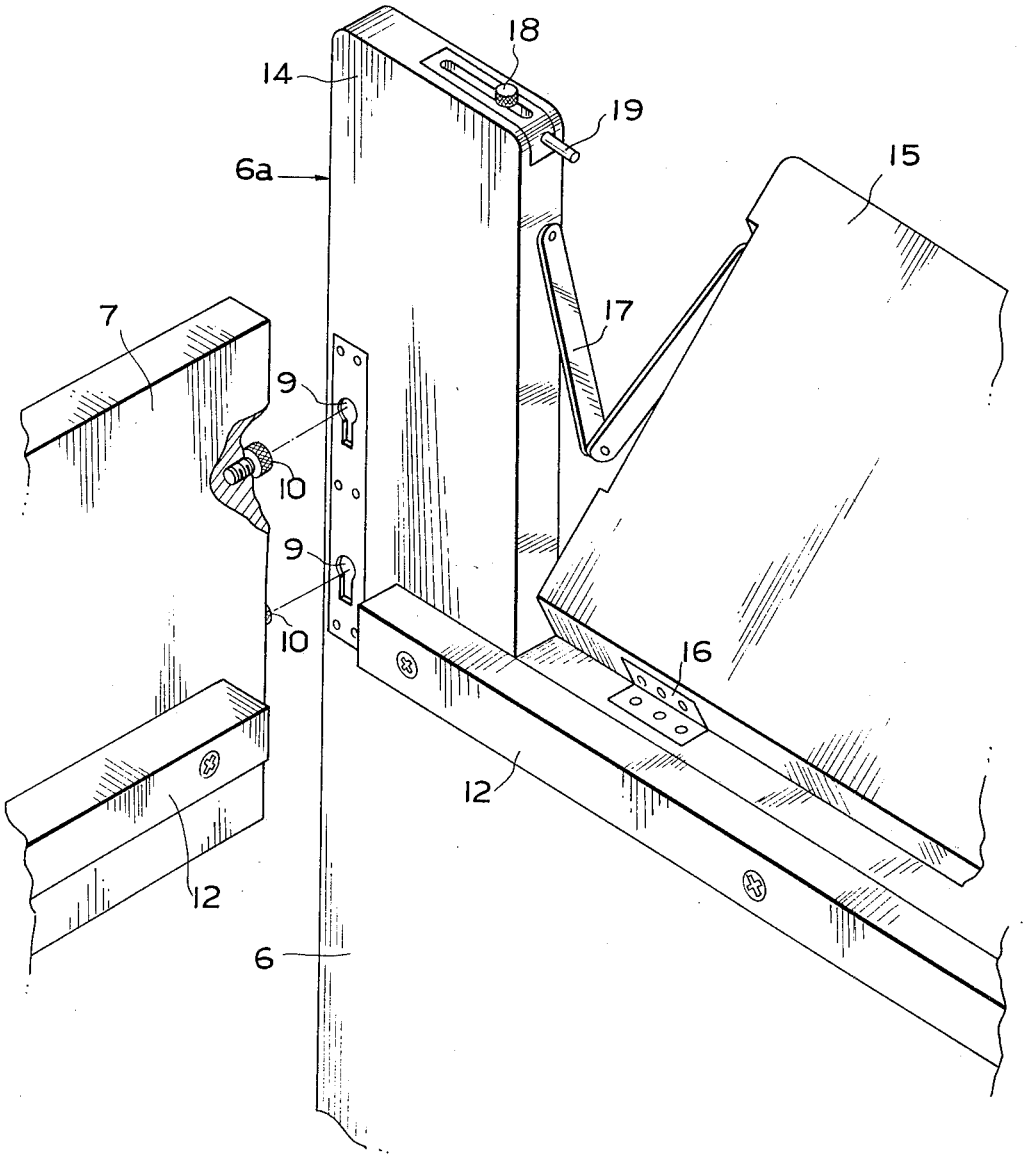
FIG. 4 is a perspective view of an essential portion of a bed section of the assembly shown in FIG. 2.

As shown in FIGS. 1 and 4, the bed section 2 includes a headboard 5*a* and a footboard 6*a* which extend downwardly so as to constitute two singular side panels 5 and 6 of the bed furniture assembly of the present invention. Between the headboard 5*a* and the footboard 6*a*, there extend crosswise elongated back and front frames 7 and 8, respectively, so that the entire framework of the bed section 2 may be constituted by these boards and frames. The back frame 7 and the front frame 8 are removably fixed to both side ends 14 of the headboard 5*a* and those of the footboard 6*a*, respectively, in such a manner that a plurality of bolthead-shaped protrusions 10 with stem portions embedded in each of the above mentioned frames 7 and 8 are inserted into keyhole-like slots 9 provided in each of the headboards 5*a* and the footboard 6*a* at positions suitable for receiving the protrusions 10. The inner wall surfaces of the headboard 5*a* and the footboard 6*a* and those of the frames 7 and 8 are provided, respectively, with horizontal support rails 12 so as to support bedmats 11 thereon and the frame 8 is further provided with a plurality of guard rods 13 on the upper edge thereof in order to prevent bedclothes from slipping down. Further, as one of the most important advantages of the present invention, the footboard 6*a* may be constituted such that it may be forced to turn upside down outwardly in the horizontal direction and, in order to enable such movement to be done, it has, in the present embodiment, such a configuration that a portion of the board 6*a* which extends from the upper edge of the board down to the support rail 12 attached thereto is cut out leaving both side end portions 14 uncut and such cutout board portion is in turn fixed pivotably as it is to the lower edge of the remaining portion of the board through a hinge 16 so that it makes itself an extension 15 of the bed section 2. In addition, a pair of double-link stays 17 are provided between the opposing inner side edges of both side ends 14 of the board 6*a* and both side edges of the extension 15 so that the extension is supported horizontally by the stays when turned outside. On the other hand, when such extension is not specifically required, it may be kept upright to become integral with the remaining both side ends 14 of the board through a pair of locking mechanisms each comprised of a slidable lock bar 19 arranged inside each side end 14, a manual operation button 18 to move the lock bar sidewardly and a hole 20 provided in each side edge of the extension 15 so as to receive the lock bar.

Figure 3:
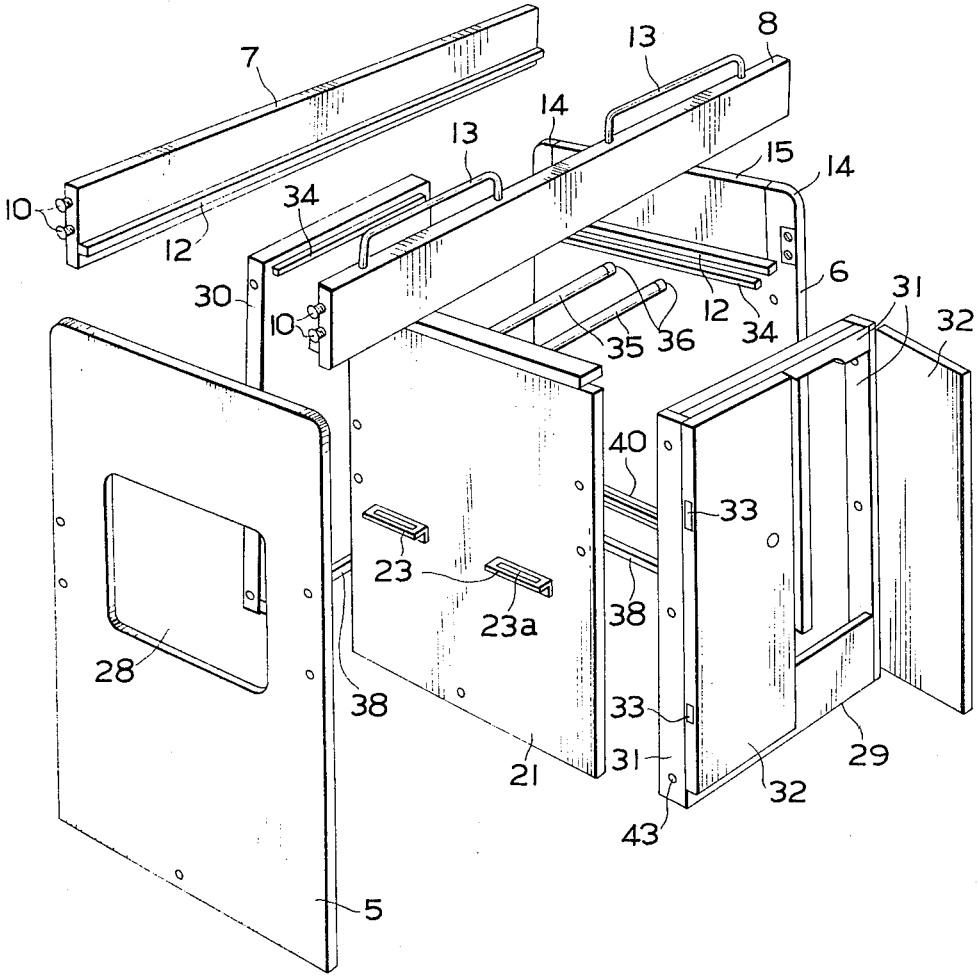
FIG. 3 is a perspective view of the bed furniture assembly shown in FIG. 2 in which to show all the structural members are disassembled.
Figure 5:
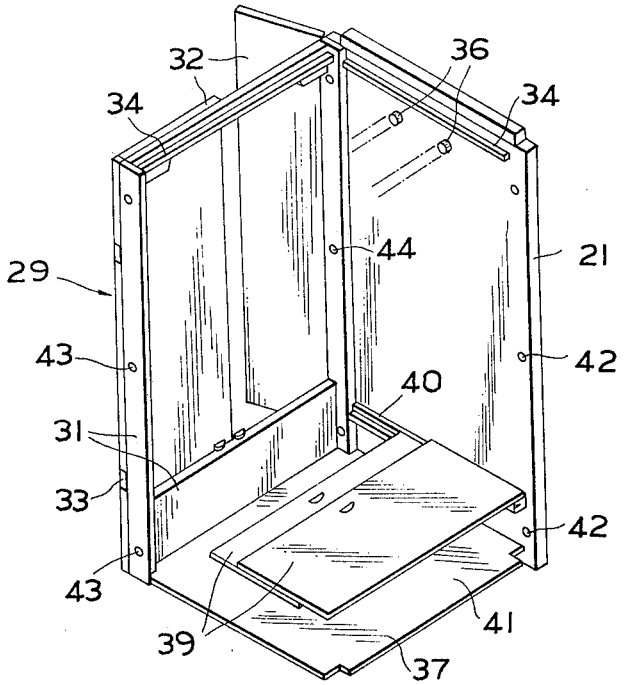
FIG. 5 is a perspective view of a housing or wardrobe section of the assembly shown in FIG. 2.

As shown in FIGS. 2 and 3 or FIG. 5, under the central portion of the bed section 2 of the above described structure, there extends downwardly a vertical center panel 21 which divides the clearance under the bed section into two portions either one of which may be assigned for the housing or wardrobe section 3 and the other for the desk or bookrack section 4 as described hereinabove. The housing section 3 includes a front panel 29 which is fitted in the front face of the section and a backpanel 30 which is fitted in the rear face thereof.

The front panel 29 is provided with a set of folding doors 32 which are fixed to a firmly prefabricated panel frame 31 by means of upper and lower angle hinges 33 so that the doors can open and close freely under a condition in which the surface of each door is fitted deep into a position lying in the same plane as the front edges of the side panel 6 and the center panel 21. Further, the upper portion of the interior of the housing section 3 is provided with a plurality of horizontal support rails 34 which are affixed to the inner walls of the housing section, respectively, in level with one another as if to form a single such rail so that an upper shelf (not shown) may be rested thereon, and the opposing inner walls of the section are provided with pipe-sockets 36, respectively, at positions below their respective upper support rails 34 so that a duplex pipe hanger 35 may be supported therethrough. Likewise, the lower portion of the interior of that section is provided with a plurality of horizontal lower support rails 38 which extend laterally along the inner walls of that section in the same manner as the upper support rails 34 as explained above so that a lower shelf 37 may be rested thereon. Further, there are provided a pair of slide rails 40 which are affixed to each of the opposing walls of the side panel 6 and the center panel 21 at a position above, and in parallel with, the support rails 38, and a pair of slide plates 39 slidable along the rails 40 independently of each other in a manner partly or fully lapped together as desired, to thereby form a clothesbox 41 in cooperation with the lower shelf 37. The desk section includes a horizontal top board 22 which is arranged at the level of the horizontal intermediate line between the opposing wall surfaces of the center panel 21 and the side panel 5 by means of a plurality of L-shaped angle fittings 23. These fittings are provided by two pairs making a total of four in number with each pair supporting the left and right sides of the lower bottom surface of the top board 22 and affixed lengthwise forwardly and rearwardly along the above mentioned opposing wall surfaces of both center and side panels. Thus, the top board 22 as a desk is removably fixed to the fittings 23 by insertion of thumbscrews (not shown) into a slit **23*a* formed in the upper strip of each fitting 23**.

The desk section 4 is further provided with a footrail or footrest 24 at the lower end portion thereof so as to help support the lower ends of the center panel 21 and the side panel 5. Also, there are provided a drawer 25, a shelf 26 and a backplate 27 of which the former two are arranged immediately below, and at a suitable height from, the top board 22, respectively, while the latter, the backplate 27, is behind the shelf so as to help support the rear end portions of the above said panels.

In addition to the above, at a portion of the side panel 5, which extends above the level of the top board 22, there is provided an opening or window 28 of suitable dimensions through which light is permitted to enter.

Figure 6:
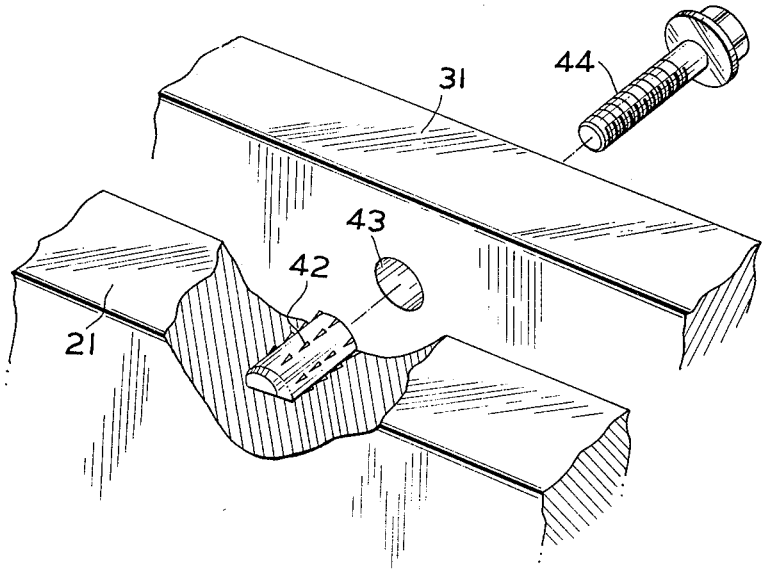
FIG. 6 is a perspective view of a portion of the bed furniture assembly of the present invention showing how to connect panels or boards for constituting the assembly.

Turning to FIG. 6 which shows an example of the manner of connection of the structural members of the present invention, the connection between the center panel 21 and the panel frame 31 can be accomplished by mere insertion of screw bolts 44 into rug nuts 42 embedded in the former panel via fixing holes 43 provided in the latter panel. Those rug nuts 42 are likewise embedded in the connecting portions of each of the above mentioned structural members such as the panels 6 and 21, the backplate 27, and those fixing holes 43 are also provided in the connecting portions of each of the panel frame 31, the backpanel 30, the side panel 5 and the center panel 21, respectively, so that all these members are removably fixed to one another by means of the screw bolts 44. Furthermore, as will be seen from FIGS. 1 and 2 or FIG. 3, the above described side panels 5 and 6 are in bilateral symmetrical relationship with each other with respect to the center panel 21 when viewed from the front. Also, the rug nuts or the fixing holes are all arranged at positions in bilateral symmetrical relationships with one another so that the location of the housing section 3 can be selectively replaced with that of the desk section 4 and vice versa by merely replacing the backpanel 30 with the front panel 29 of the former section and by rearranging the backplate 27 and the top board 22 of the latter section in an inversed fashion.

The fabrication of the bed furniture assembly of the above described structure may be accomplished as follows: First, the bedframes 7 and 8 are connected to the side panels 5 and 6 by insertion of the protrusions 10 of both ends of the formers into the slots of the latters, respectively, and the frames are pushed down. Then, the backplate 27 and a footrail 24 are arranged at predetermined positions respectively between the center panel 21 and the side panel 5 and the connecting portions between them are tightly fixed by means of screw bolts 44 from outside the panels 5 and 21. Then, the backpanel 30 is fitted between the side panel 6 and the center panel 21 and fixed tightly to the latter two with screw bolts 44 and then the upper and lower shelves, the duplex hanger pipes 35 and the slide plates 39 are fixed in position within the housing section. The front panel 29 is fitted in position and fixed in the same manner as in the case of the other panels, and the bedmats 11 are placed on the support rails 12 of the bed section and the horizontal top board 22 serving as a desk is rested on the fittings 23 of the desk section, to thereby complete the bed furniture assembly. On the other hand, when it is desired to disassemble the structure, the above order of fabrication is reversed. Then, all the structural members are separated and the bed section as well as the desk section are completely disassembled, and the separated structural members can be laid flat and stored in a compact form. Thus, since both the housing section and the bed section which occupy a large space can be completely disassembled, the volume of the disassembled furniture will become extremely small as compared with that of the assembled one.

Figure 7:
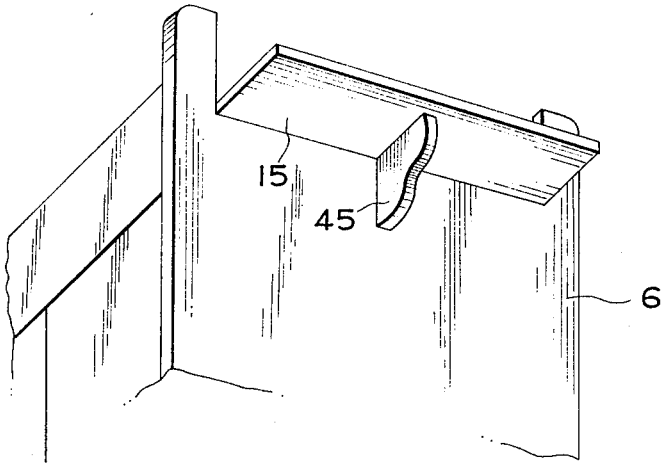
FIGS. 7 and 8 are perspective views of modifications of the bed section shown in FIG. 2, respectively.
Figure 8:
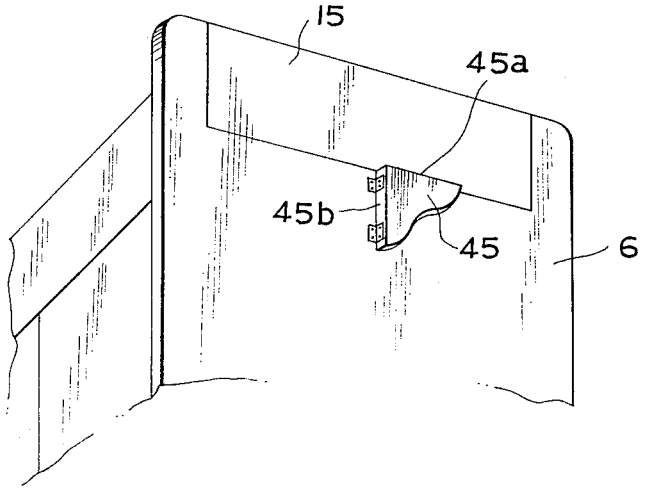

FIGS. 7 and 8 show a modification of the embodiment of FIGS. 1 to 6 in which the extension 15 is supported by a support plate 45 (instead of the stays 17) at the lower central portion of the extension when the extension is turned outside in the horizontal direction.

This support plate 45 has an upper side edge 45*a* and a vertical side edge 45*b* at which the latter is pivotably fixed to the outer wall surface of the side panel 6 through hinges 46.

As described hereinabove, the bed furniture assembly of the present invention has the following various advantages:

(1) Since the structural members of the assembly are removably fixed to one another while they can be laid flat one above another to be received in position. For example, in a container, no wide space is required for the custody thereof in the process of its circulation such as transportation as well as in storage and it is therefore easy to handle and reduces the selling cost.

(2) Since the headboard and the footboard, which form part of the bed section, extend downwardly to serve as both side panels of the entire bed furniture structure and since either one of the panels can be utilized as one of the side walls of the housing section in which the backpanel is fitted between the side panel and the center panel at the rear face of that section defined by the above mentioned both panels while the framed front panel provided with a set of folding doors is fitted in the front face of that section. Thus, the load of the bed section is applied directly upon each panel and a force of deflection or distortion is borne upon by the back and framed front panels. Accordingly, the bed furniture structure according to the present invention makes itself extremely solid and firm despite its complete knockdown type structure.

(3) Since a portion of the headboard or the footboard can be utilized as an extension of the bed section which is pivotable outside in the horizontal direction, the bed can be selectively extended lengthwise in proportion to the height of the user and, therefore, the bed section can be made compact in length without any difficulty in use. Furthermore, even if the bed section is initially formed of sufficient length, the extension may still be utilized as a bedside table.

It should be noted that although the present invention has been illustrated and described with reference to its preferred embodiment and a minor variation in part thereof, it is nevertheless not intended to be limited thereto since various modifications and changes may be made possible without departing from the spirit and scope of the present invention.

What is claimed as new and desired to be secured by a Letters Patent of the United States is:

1. In a bed furniture assembly including a bed section arranged at the upper portion of the assembly, a housing section and a desk section arranged on one and the other sides, respectively, of a clearance provided under the bed section, which comprises:

a plurality of substantially flat panels, boards and frames adopted to constitute the assembly;

means for removably fixing said panels, boards, and frames to one another when assembled to form said bed section, housing section and desk section and, such that, when disassembled, said panels, boards, and frames are capable of being laid substantially flat one above another, said plurality of panels including first and second upright end panels between which said bed section, housing section and desk section are positioned and said plurality of frames including at least said first and second frames interconnecting said first and second end panels and further comprising a third upright panel separating said housing section and said desk section.

2. The bed furniture assembly as claimed in claim 1 wherein said housing section is defined by said first end panel and said third panel and a backpanel and comprises a rectangular prefabricated frame member;

means for removably fixing said prefabricated frame member between the opposing wall surfaces of both of said panels defining said housing section, said prefabricated frame member including a set of folding doors attached to the front face of said prefabricated frame member through a plurality of hinges, and means for removably attaching said set of folding doors to both of said panels through said frame member as an integral portion of the latter such that when disassembled, said prefabricated frame member is capable of being substantially flat with said panels, boards and frames.

3. The bed furniture assembly as claimed in claim 1 or 2 in which a headboard and a footboard which form part of said bed section extend downwardly to form said first and second end panels of the assembly, said bed section being fixed, at the lower central portion thereof, with said third panel which extends downwardly in parallel relationship with said first and second end panels so as to define said housing section and said desk section in cooperation with said first and second end panels.

4. The bed furniture assembly as claimed in claim 1 or 2 in which one of said headboard and said footboard includes a portion capable of serving as an extension of said bed section such that said extension is pivotable at the lower edge thereof and, when in use, turns upside down outwardly of said bed section so as to be held in the horizontal direction.

5. The bed furniture assembly as claimed in claim 1, said means for removably fixing said panels, boards, and frames comprising at least a plurality of nut members mounted in said panels and bolt members cooperatively engaging said nut members.

6. The bed furniture assembly as claimed in claim 1, said means for removably fixing said panels, boards, and frames further comprising:

slots formed in said panels and second bolt members connected to said frames for engagement with said slots formed in said panels.

* * * * *